United States Patent [19]

Schneider

[11] 3,946,947

[45] Mar. 30, 1976

[54] FOAM GENERATING APPARATUS

[75] Inventor: Barry L. Schneider, Crystal Lake, Ill.

[73] Assignee: Chemtrust Industries Corporation, Franklin Park, Ill.

[22] Filed: Nov. 14, 1974

[21] Appl. No.: 523,740

Related U.S. Application Data

[63] Continuation-in-part of Ser. No. 396,183, Sept. 11, 1973, abandoned.

[52] U.S. Cl. ..... 239/401; 239/311; 239/402.5; 239/403; 239/428.5; 239/434.5; 239/467; 239/485

[51] Int. Cl.[2] ..... B05B 1/30; B05B 1/34; B05B 7/04

[58] Field of Search ..... 239/8, 214.25, 302, 310, 239/311, 313, 329, 318, 399, 335, 336, 401, 402.5, 375, 403, 428.5, 419.5, 434.5, 467, 420, 474, 475, 526, 483–485; 169/15

[56] References Cited

UNITED STATES PATENTS

| | | | |
|---|---|---|---|
| 1,563,123 | 11/1925 | Wade | 239/434.5 |
| 1,605,177 | 11/1926 | Diener | 239/434.5 X |
| 1,748,248 | 2/1930 | Shepherd | 239/467 X |
| 2,231,782 | 2/1941 | Thompson | 239/313 X |
| 2,624,622 | 1/1953 | Holte | 239/375 X |
| 2,760,821 | 8/1956 | Kenney | 239/335 |
| 2,764,452 | 9/1956 | Anderson et al. | 239/310 |
| 3,446,285 | 5/1969 | Hout | 169/15 |
| 3,547,200 | 12/1970 | Hout | 169/15 |
| 3,625,436 | 12/1971 | Wirths | 239/419.5 |
| 3,739,989 | 6/1973 | Vasper | 239/399 |
| 3,797,749 | 3/1974 | Tada | 239/526 X |
| 3,814,329 | 6/1974 | Clark | 239/526 X |

*Primary Examiner*—Robert S. Ward, Jr.
*Attorney, Agent, or Firm*—Wallenstein, Spangenberg, Hattis & Strampel

[57] ABSTRACT

A foam generating nozzle is made either as an attachment to an existing liquid spray nozzle unit or as a premanufactured assembly and includes a foam-generating section having a pressure-reducing passageway including a preferably sharply outwardly tapering portion leading to a venturi-forming throat portion, and adapted to receive the liquid stream issuing from an inlet orifice. Air inlet ports are provided communicating with the pressure-reducing passageway, through which ports air is drawn by the reduced pressure caused by the pressure-reducing passageway. Optimum foaming action is achieved by adjusting the point of the pressure-reducing passageway struck by the stream which is most advantageously achieved by adjusting the angle of the stream issuing from the orifice so the widest portion thereof strikes the end section of the tapering portion of the passageway.

20 Claims, 25 Drawing Figures

FIG. 8A
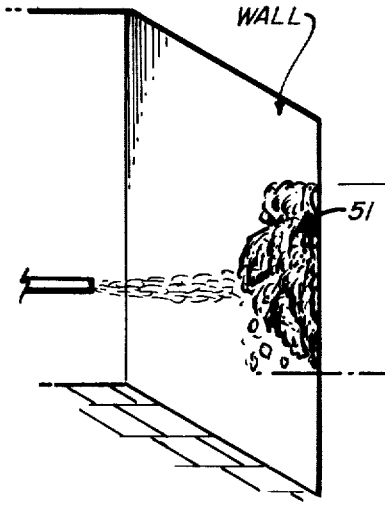
FIG. 8B
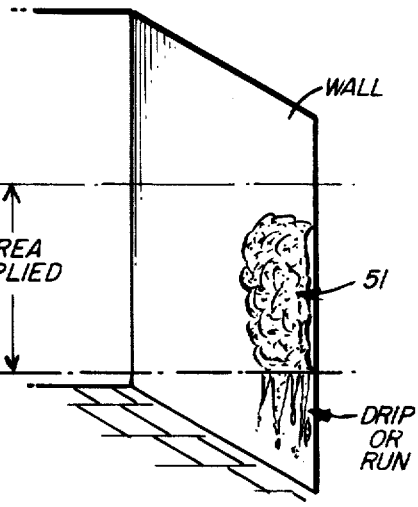
FIG. 9A
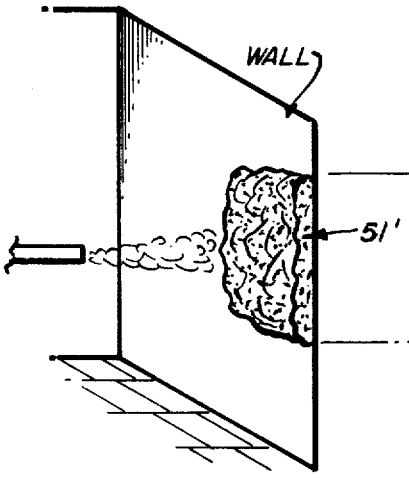
FIG.9B
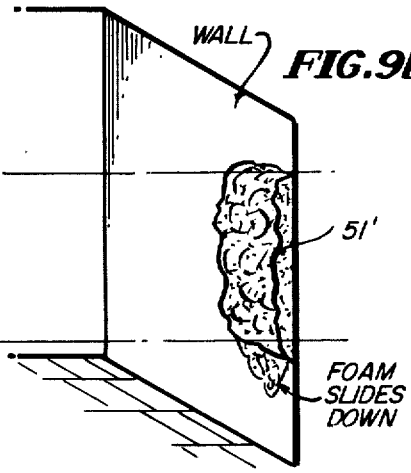
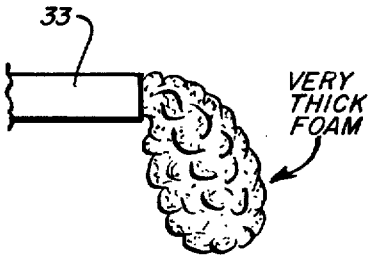
FIG. 10
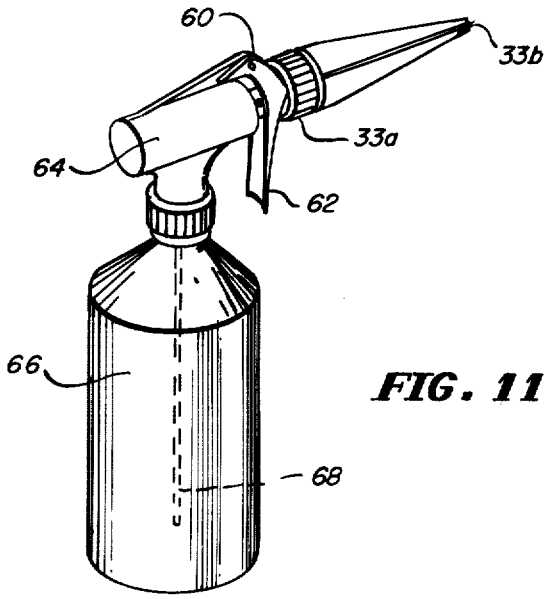
FIG. 11

FIG. 19
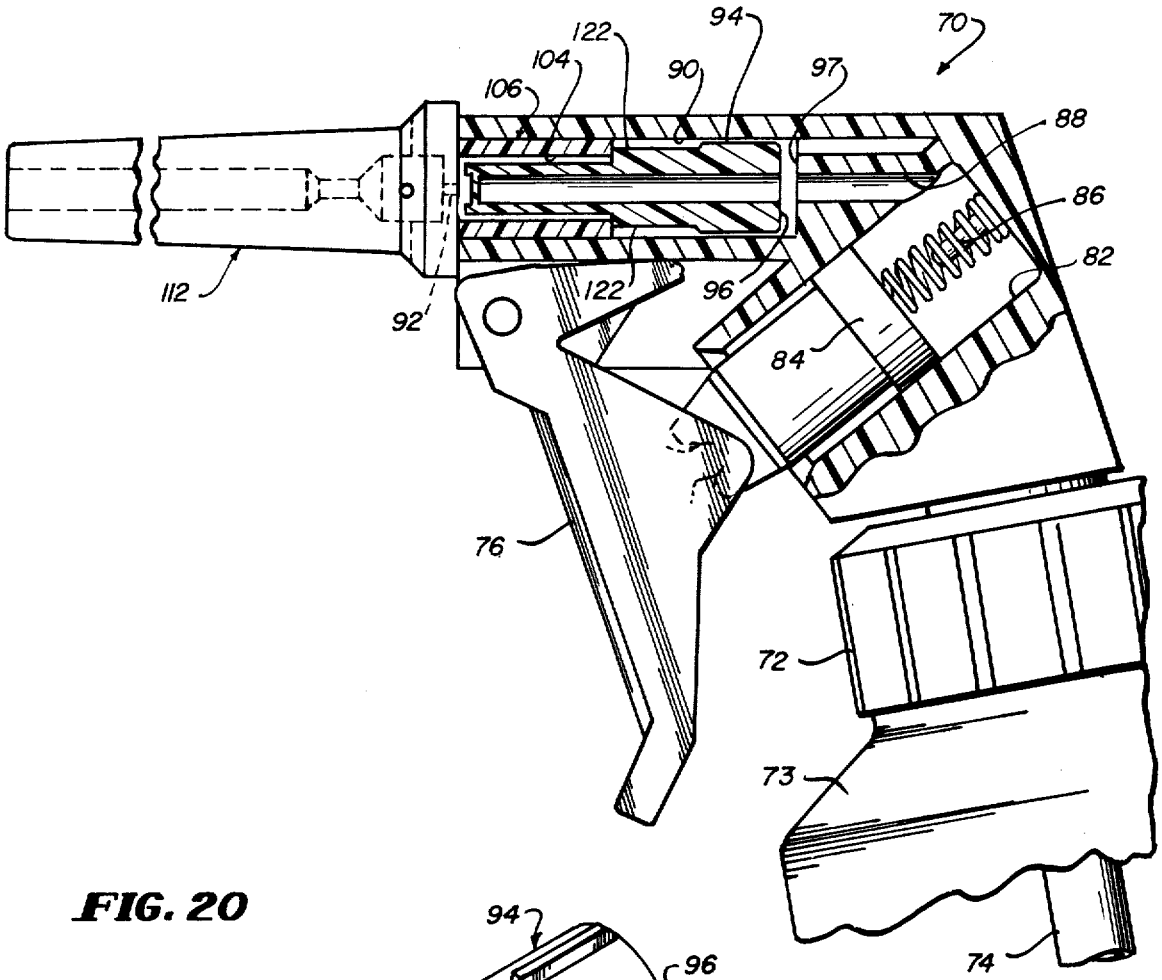
FIG. 20
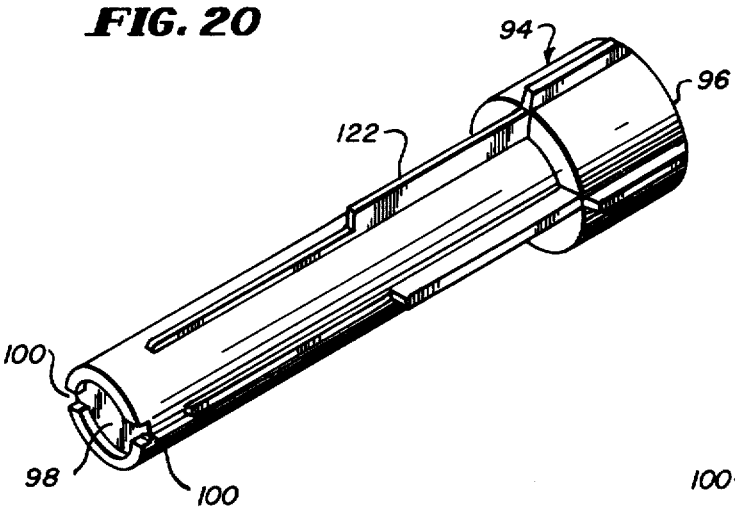
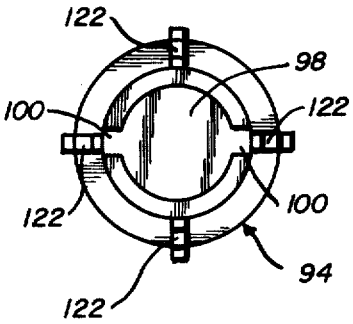
FIG. 21

FOAM GENERATING APPARATUS

RELATED APPLICATION

This application is a continuation-in-part of application Ser. No. 396,183, filed Sept. 11, 1973 and now abandoned, and entitled, FOAM GENERATING APPARATUS.

BACKGROUND OF THE INVENTION

The present invention relates to foam generating nozzles and foam generating systems utilizing the same, and which, while having application for the dispensing of a wide variety of chemicals, has its most important application in the dispensing of cleaning chemicals.

The application of chemicals in a foamed condition is frequently desirable for a number of reasons. Thus, it permits the application of chemicals with lower spray rates and active chemical content with the advantage of reduced costs. Also, especially when spraying vertical or downwardly facing horizontal surfaces, maximum contact time of the foamed material on the surface involved is achieved. Additionally, it eliminates the health and safety hazards caused frequently by liquid sprays which by splashing or otherwise forms tiny droplets or a fine mist which is inhaled and strikes the eyes to cause great discomfort and sometimes serious harm to the persons involved. The application of the material in a foamed state reduces or eliminates the tiny droplets or mist formation which causes these health and safety hazards.

The application of agricultural chemicals by spraying from airplanes and the like by foam generating equipment including a nozzle unit which mixes air with the liquid chemical is well known. Occasionally, cleaning chemicals have been applied by foam-producing aerosol and other type dispensing units. Also, the foaming of a mixture of water and a foaming agent issuing from a nozzle is in common use by firemen.

Many materials such as soaps can be readily foamed by mild agitation, and other materials are more difficult to apply in the foamed condition. Foaming agents can sometimes be added to the latter materials to increase their foamability when agitated by passage through an aerosol nozzle or when mixed with air in an aerating nozzle.

The type of foam achieved by a particular foam generating nozzle unit is a function of a number of factors, such as the nature of the material being sprayed, the pressure of the material when applied to the nozzle unit and the design of the nozzle unit. Also, the desired consistency of the foam to be developed by a particular nozzle unit depends upon the particular application involved. Thus, for applications involving a prolonged desired retention on vertical and downwardly facing horizontal surfaces, it is usually desirable to apply the material involved as a thick foam. Also, it has been discovered that the penetrating power of a material applied to a porous surface is often maximized by applying the material in a foamed condition with minimum sized foam bubbles, which is generally characteristic of a thick foam. In many applications, a thin foam is desired. It is advantageous, therefore, that a given foam generating nozzle unit be readily adjustable to provide a selection of degrees of foaming action with a given chemical and so that the nozzle unit can provide an optimum desired foam with chemicals having different foaming properties and under varying pressure conditions.

Foam generating nozzle units heretofore developed have been less than completely satisfactory for a number of reasons, including their size, complexity and high cost, and/or their inability to be readily adjustable significantly to vary the degree of foaming action achieved thereby or to provide an optimum foam with a wide variety of foamable chemicals, and inlet pressures.

Some examples of foam generating nozzle units heretofore developed are shown in the following patents:

U.S. Pat. No. 3,701,482
U.S. Pat. No. 3,446,485
U.S. Pat. No. 2,766,026
U.S. Pat. No. 2,556,239
U.S. Pat. No. 3,094,171
U.S. Pat. No. 3,547,200
British Pat. No. 627,285

One form of foam generating nozzle unit heretofore developed and which is disclosed in U.S. Pat. No. 3,701,482 includes at the inlet end thereof one or more small orifices through which unaerated liquid passes at a relatively high velocity into the relatively large inlet chamber of a venturi unit having a gradually converging portion communicating with a venturi-forming throat which communicates with an expansion chamber at the outlet end of the nozzle unit. Air ports are located just beyond the high velocity nozzle, through which ports air is sucked by the low pressure developed in the venturi-forming throat. The design of this nozzle unit is such that significant foaming action occurs in only the expansion chamber. The rate of foaming was thought to be a function mainly of the relative size of the throat of the nozzle unit and the total area of the high velocity orifices. The change in foaming action, therefore, required a change in the size of the orifices which did not lend such units to a practical progressive adjustment of the degree of foaming action obtained.

U.S. Pat. No. 3,547,200 to Hout discloses a foam-producing attachment for fog nozzles of the character employed by firemen, in which attachment a variable angle spray pattern issuing from the fog nozzle initially strikes and passes through a conical screen. The flow of the material through the screen causes air to be drawn through the attachment. The velocity of the liquid stream and the air causes a rapid expansion of the foamed stream passing through the screen. The characteristics of the foam stream issuing from the conical screen including the throw of the foam stream are stated to be varied with the angle of the stream issuing from the fog nozzle. In an experiment performed on a commercial form of the device shown in this patent, upon removal of the conical screen, the foam thickness greatly dissipated and the resulting modest character of the foam was about the same as that produced by the fog nozzle separated from the attachment, and the thickness of the foam did not vary significantly with the angle of the stream issuing from the fog nozzle.

The commercial form of this device is a large and unwieldy device being approximately 1¾ feet in diameter and 3½ feet long and uses a mesh size for conical screen which is unsuitable for use in hand sprayers. Thus, if the size of all parts of the device were to be proportionately reduced to be attachable to hand operated trigger sprayers, the mesh size would be so small as to be incapable of operating on the same principle as the sprayer of the patent, where the liquid stream passes through the same.

British Pat. No. 627,285 discloses a non-adjustable foam producing device wherein a diverging stream is caused to strike the wide end of a modestly tapering passageway where air is drawn into the stream causing the foaming thereof. The stream passes through a long cylindrical passageway forming an extension of the narrow end of the tapered passageway.

SUMMARY OF THE INVENTION

In accordance with one of the features of the foam generating nozzle unit of the present invention, it has been discovered that a progressive control over the degree and quality of foaming action is achieved in a foam generating nozzle unit of the air aspirating type (i.e., a unit having an orifice opening onto a pressure-reducing passageway which creates a low pressure which draws air into the passageway through air ports provided thereat) by providing a progressive control over the area and/or points of the pressure-reducing passageway struck by a stream emanating from the orifice. In the most preferred form of sprayer of the invention, this control is achieved by varying the angle of the stream issuing from the orifice. The pressure-reducing passageway most advantageously comprises a sharply outwardly tapering portion terminating in a throat portion. In the preferred variable angle stream embodiment, a narrow stream flowing from the orifice which strikes only the outer portion of the walls of the throat portion of the nozzle (or passes therethrough without striking the throat walls) will produce a stream with a long throw but with a modest degree of foam. Progressively increasing the angle of the stream flowing from the orifice causes the stream to strike greater extents of the throat portion to produce a modest increase in the degree of foam produced. An unexpectedly sudden increase in foaming action occurs with only an insignificantly modest reduction in the spray distance when the widest portion of the diverging stream issuing from the orifice strikes the end section of the tapered portion of the pressure-reducing passageway. Such a spray pattern thus produces an optimum foam spray. This optimum condition of substantial foaming action with substantial throw when the widest portion of the diverging stream strikes the outer section of the tapered portion of the air pressure-reducing passageway exists for all angles of divergence of a stream flowing from the orifice. In other words, if the angle of the stream issuing from the orifice is fixed at any one of a number of diverging angles but its axial position is varied relative to the pressure-reducing passageway, the degree of foam and the throw of the foam stream is varied as before, reaching an optimum condition when the widest portion of the stream strikes the end section of the tapered portion of the pressure-reducing passageway. However, the adjustment of the foam quality is most easily achieved by varying the angle of the stream issuing from the orifice and thus is the preferred form of the invention.

When spraying cleaning chemicals in a foamed state upon a vertical surface, the optimum foam condition when the widest portion of the spray strikes the end section of the tapered passageway produces the most useful foam, not only because it gives a substantial throw with significant foaming action, but also because the thickness of the foam which can be built up on the wall surface is maximized. This result is believed to be due to the fact that when the foam material strikes a vertical surface under appreciable pressure, the foam thickness increases because of the forces applied to the liquid at the impact point. When what appears to be a thicker foam spray strikes a vertical wall surface at a low velocity, the foam does not build up to or remain for any appreciable time at the same thickness on the wall and drops much more quickly from the wall.

It is common to provide in a non-foaming nozzle unit a variation in the angle of divergence of the stream issuing from the outermost end of the nozzle unit. One form of the present invention is an attachment for the end of such a non-foaming nozzle unit which converts the same to a foam generating nozzle unit where foam thickness is progressively adjustable. The present invention is most useful in small hand pump spray units which are commonly attached to bottles of cleaning materials and the like, but is also useful in devices such as compressed air tank sprayers and in spraying systems using motor driven pumps.

DESCRIPTION OF THE DRAWINGS

FIGS. 8A and 9B respectively show the condition of the foam applied by a foam generating nozzle unit of the present invention adjusted to apply a thin foam as the foam initially strikes a vertical wall surface and a number of seconds thereafter;

FIGS. 9A and 9B respectively show the condition of the foam applied by a foam generating nozzle unit of the present invention adjusted to apply a thick foam as the foam initially strikes a vertical wall surface and a number of seconds thereafter;

FIG. 10 illustrates an extremely adjusted foam generating nozzle unit of the present invention where, while the foam sprayed is thick, it discharges foam with practically no force, making it impractical to use in such as adjusted condition;

FIG. 11 is an elevational view of a bottle containing a window cleaning chemical or the like, with a conventional cap assembly including a hand pump and nozzzle assembly to which is attached a foam generating nozzle unit constituting another form of the present invention;

Figure 12:
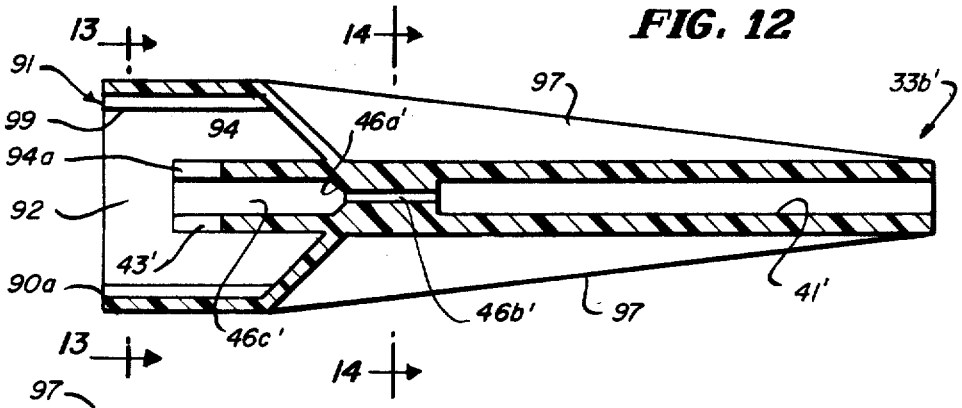
FIG. 12 is an enlarged longitudinal sectional view of the foam generating nozzle unit shown in FIG. 11.
Figure 13:
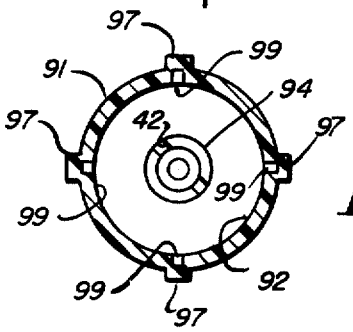
FIG. 13 is a transverse sectional view of the attachment shown in FIG. 12, taken along section line 13—13 therein.
Figure 14:
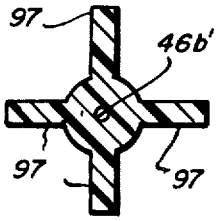
Figure 15:
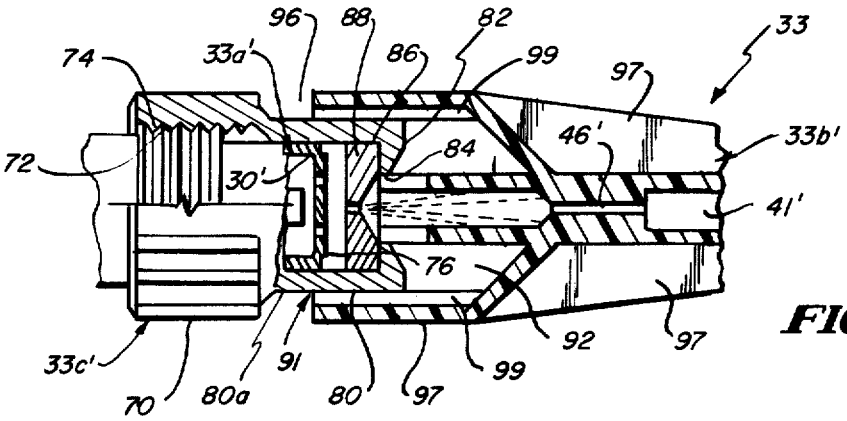
Figure 16:
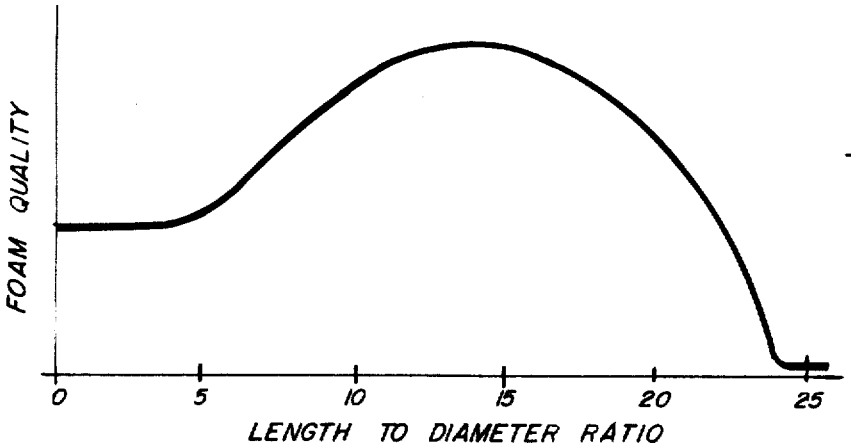
Figure 17A:
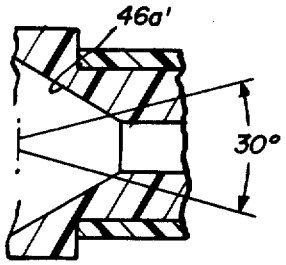
Figure 17B:
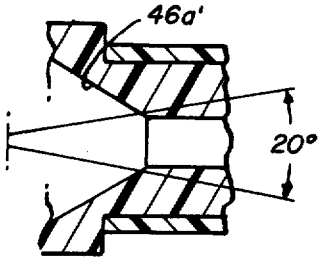
Figure 17C:
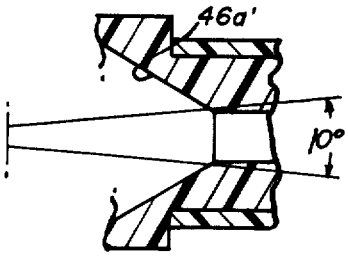
Figure 18:
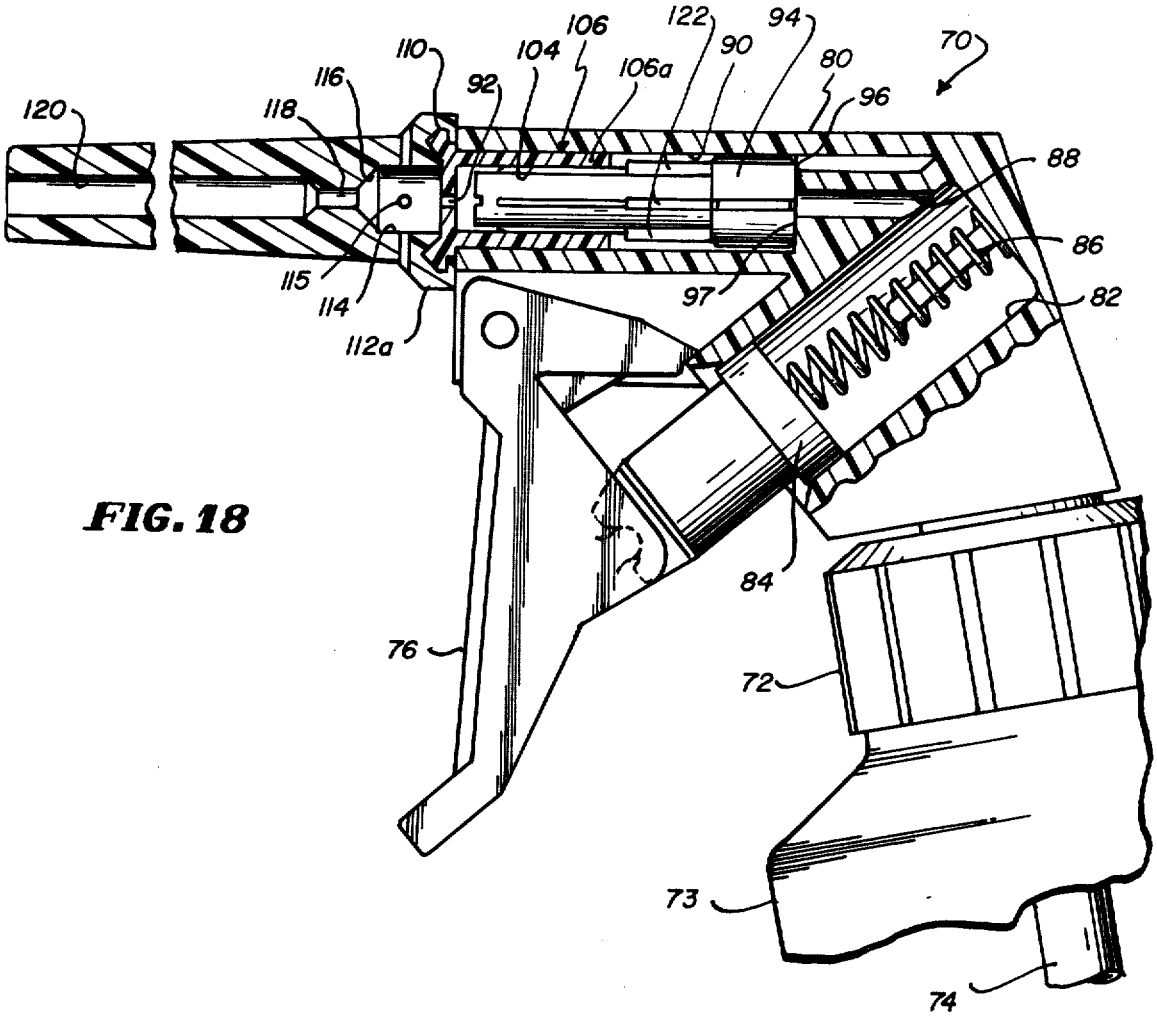

FIG. 14 is a transverse sectional view of the attachment of FIG. 12, taken along section line 14—14 therein;

FIG. 15 is an enlarged partial, fragmentary, longitudinal sectional view through the inlet end of the attachment of FIG. 12 mounted upon a manually adjustable member of a conventional liquid spray nozzle unit forming part of the hand pump and nozzle assembly shown in FIG. 11;

FIG. 16 illustrates a curve showing the variation in foam quality with the length to diameter ratio of the expansion chamber portion of the nozzle units of FIGS. 1–15;

FIGS. 17A, 17B and 17C illustrate respectively different angles of spray pattern issuing from a nozzle unit and the points of the pressure-reducing passageway struck thereby for optimum foam quality;

FIG. 18 illustrates a partially sectioned view through a non-adjustable sprayer head before the sprayer is operated;

FIG. 19 illustrates a partially sectioned view through the non-adjustable sprayer head of FIG. 18;

FIG. 20 is an enlarged perspective view of a fluid-directing member forming part of the hand trigger sprayer of FIGS. 18 and 19; and FIG. 21 is an end view through the front end of the fluid-directing member shown in FIG. 20.

DESCRIPTION OF THE PREFERRED EMBODIMENTS OF THE INVENTION

Figure 1:
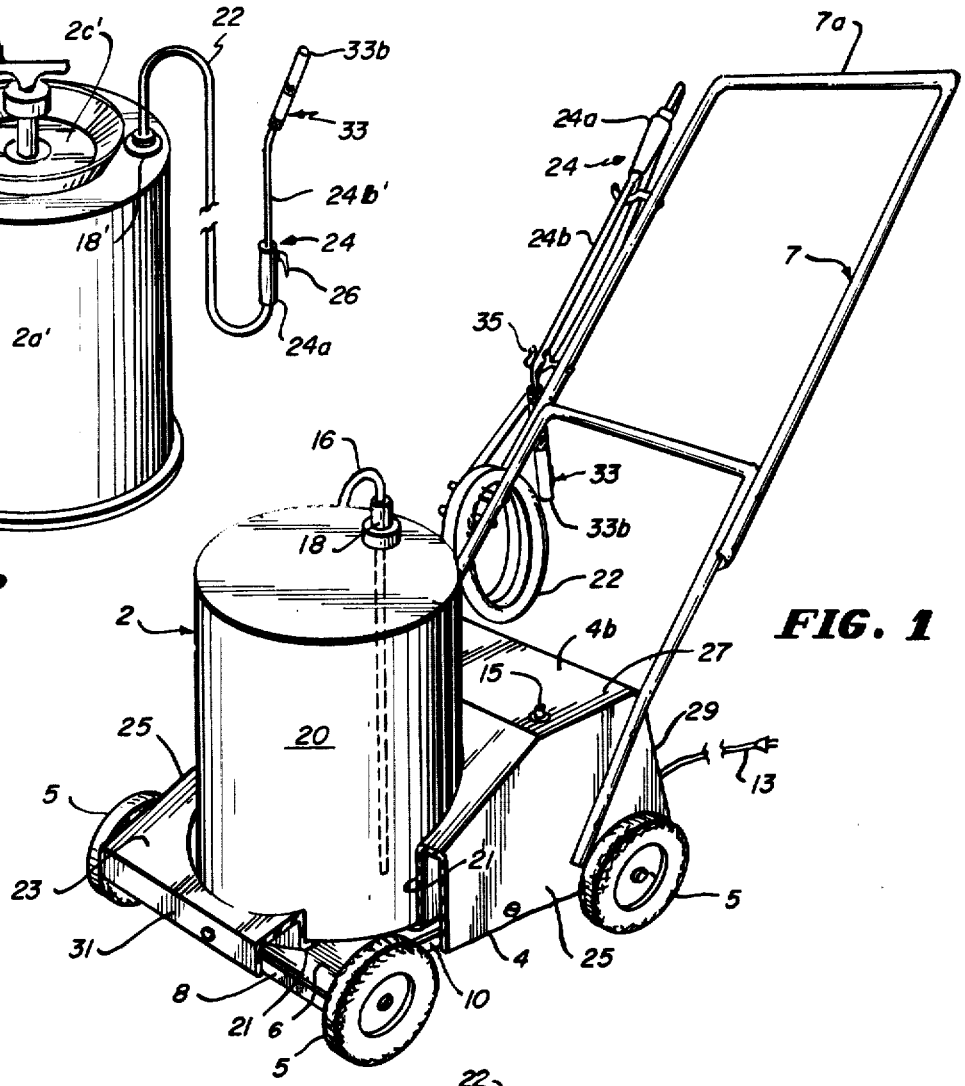
FIG. 1 illustrates a unique mobile foam dispensing unit having particular utility for dispensing cleaning chemicals and which includes a unique foam generating nozzle attachment which converts a conventional-type liquid spray nozzle into a foam generating nozzle.
Figure 3:
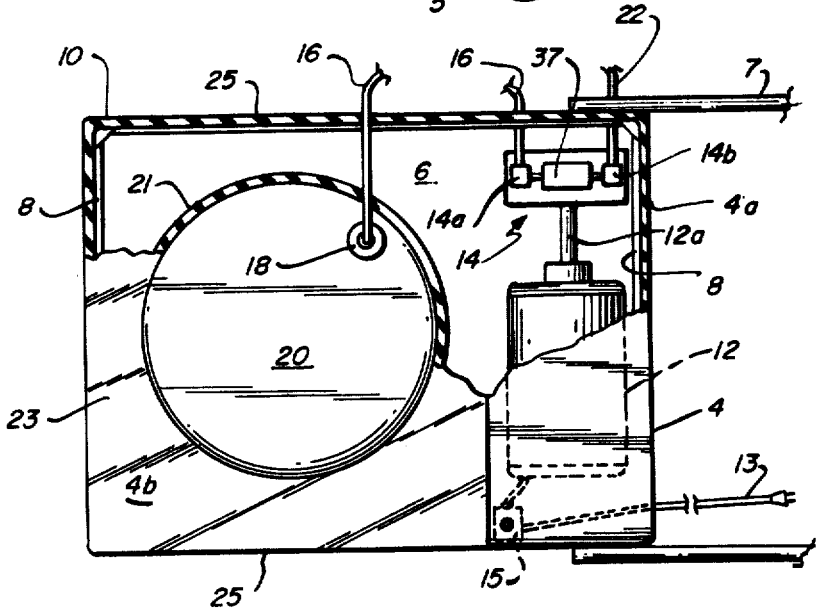
FIG. 3 shows a fragmentary plan view, partly broken away, of the mobile unit of FIG. 1.
Figure 4:
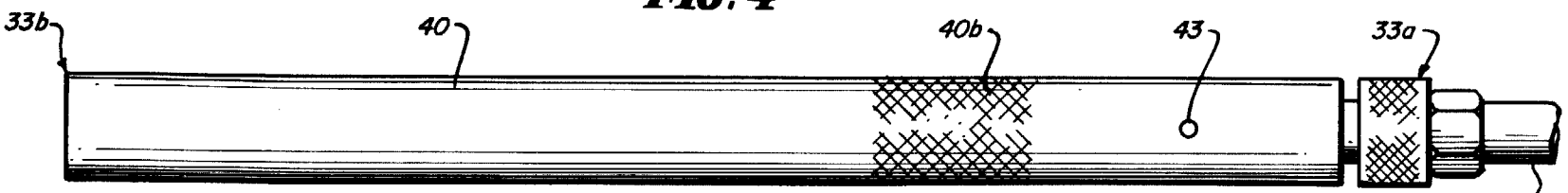
FIG. 4 is an enlarged side elevational view of the foam generating nozzle attachment units used in the sprayer shown in FIGS. 1–3.

Referring now more particularly to FIGS. 1 and 3, a portable mobile cleaning unit 2 is there shown which is used to apply a cleaning chemical or the like in a foamed condition. The mobile cleaning unit 2 resembles in a general way a lawn mower in that it includes a low profile base and housing assembly 4 mounted on wheels 5 and a tubular structure generally indicated by reference numeral 7 attached to the sides of the rear portion of the base and housing assembly 4 and extending upwardly and rearwardly where it terminates in a handle grip portion 7*a* which can be comfortably grasped to manually propel the mobile cleaning unit to various points in or around a building or other structure to be cleaned.

The base and housing assembly 4 comprises a base structure 4 including a horizontal support platform 6 from the margins of which upwardly extend end walls 8—8 and side walls 10—10 forming an open top box-like structure. On the rear portion of the support platform 6 is an electric motor 12 (or other suitable source of motive power like an internal combustion engine). Where an electric motor is utilized, a power cord 13 is provided which extends to a suitable power on-off switch 15 (shown in the drawings at the top of the base and housing assembly 4) and then to the electric motor 12. The electric motor 12 has a horizontal shaft 12*a* extending to a conventional pump unit 14, which has an inlet 14*a* from which extends a flexible conduit 16 passing through a fitting 18 into the bottom portion of a drum or other container 20 containing the cleaning chemical to be dispensed. The liquid in the drum 20 may be any suitable foamable liquid, and will generally include a water soluble cleaning material and possibly other additives, together with a foaming agent, where necessary, to provide a foam when the mixture delivered from the drum 20 is agitated in a manner to be explained.

The drum 20 is confined by a vertical cylindrical wall 21 extending downwardly from the inclined wall 23 of a housing 4*b* to engage the platform 6 to form a well in which the drum 20 is held in place on the platform 6. The well-forming wall 21 together with the rest of the housing isolates the motor and pump from the exterior thereof. The housing 4*b* may be a synthetic plastic molded body including, in addition to the inclined wall 23 from which the depending cylindrical wall 21 extends, side walls 25—25, a rear top wall 27, a rear wall 29 bridging the rear top wall 27 and the side walls 25—25, and a narrow flange 31 depending from the front margin of the inclined wall 23. The housing 4*b* may be secured to the walls 8—8 and 10—10 of the base structure 4*a* in any suitable way, such as by screws passing through housing flange 31, side walls 25—25 and rear wall 29 and threading into the walls 8—8 and 10—10 of the base structure.

The pump 14 has an outlet 14*b* connected by a flexible conduit 22 to a handle and nozzle assembly generally indicated by reference numeral 24. The handle and nozzle assembly 24 includes a handle portion 24*a* from which extends a lever 26 which, when depressed opens a valve (not shown) to permit passage of liquid into a rigid tube 24*b* terminating in a discharge nozzle assembly generally indicated by reference numeral 33. The handle and nozzle assembly 24 may be anchored in any suitable way to the tubular structure 7, such as by a suitable clamp 35 attached to the tubular structure.

When the electric motor 12 is operating, the pump 14 will be rotated to draw fluid from the conduit 16 and force fluid into the conduit 22. When the lever 26 of the handle and nozzle assembly 24 is depressed to open the valve associated therewith, the fluid will flow through the discharge nozzle assembly 33. When the lever is released, the valve involved will be closed, and, to prevent undue back pressure on the pump 14, a normally closed pressure relief valve 37 associated with the pump will open to direct fluid which cannot flow through the outlet conduit 22 to some other location, which may be through a conduit (not shown) extending back into the drum 20 or, as shown, to the inlet 14*a* of the pump 14.

Figure 5:
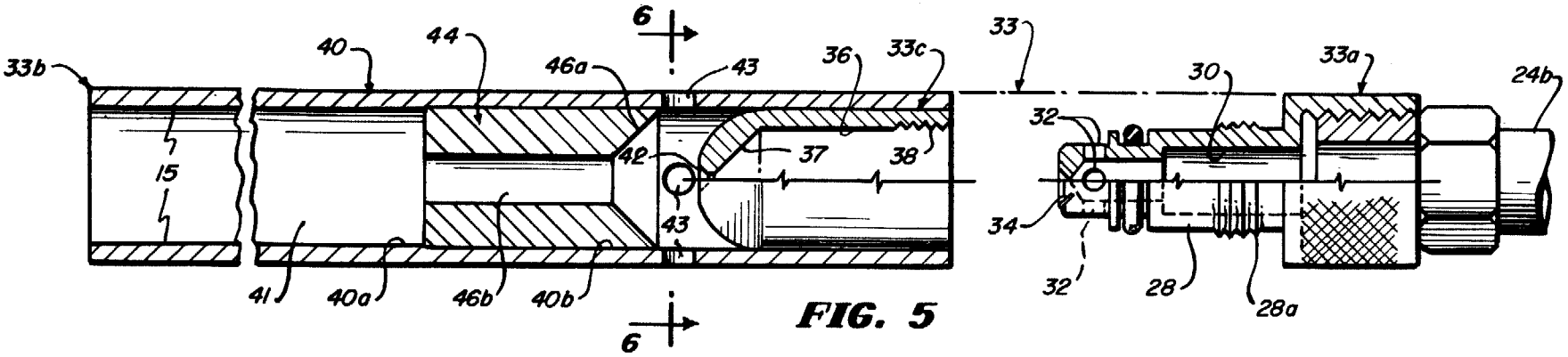
FIG. 5 is an exploded partial longitudinal sectional view of the foam generating nozzle attachment shown in FIGS. 1–4, separated from a portion of a conventional liquid spray nozzle unit to which it is attached.
Figure 7:
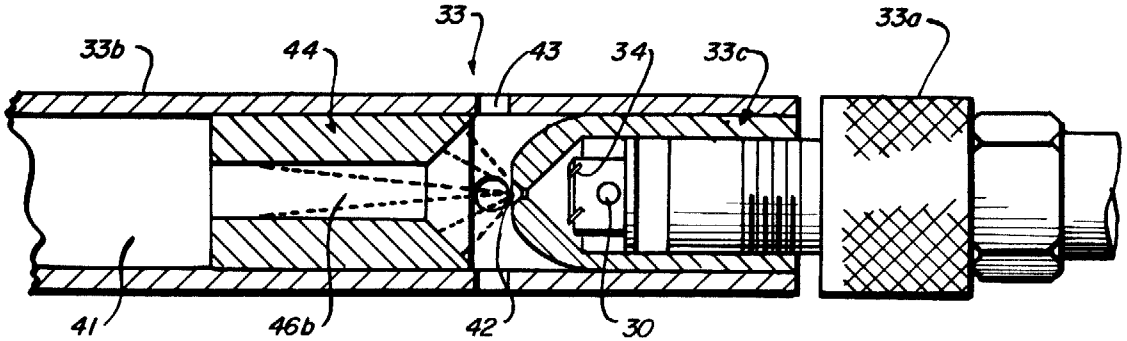
FIG. 7 is a longitudinal sectional view through the attachment of FIGS. 4 and 5 when attached to a portion of the liquid spray nozzle unit shown in FIG. 5.
Figure 6:
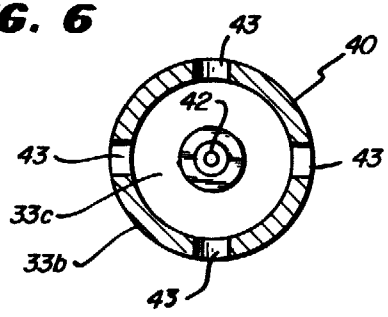
FIG. 6 is a transverse sectional view through FIG. 5 taken along section line 6—6.

As shown in FIG. 5, the discharge nozzle assembly 33 illustrated comprises a well known nozzle part 33*a* which, together with another well known spray angle adjusting member 33*c* to be described, forms a conventional non-foaming liquid spray nozzle of the type sold by the Chapin Manufacturing Works of Batavia, New York. The spray angle adjusting member 33*c* is rotatably adjustably supported upon the nozzle part 33*a* and produces a diverging spray pattern issuing from a discharge orifice 42 of the member 33*c* with an angle of divergence depending upon the particular rotational position of the member 33*c* upon the valve part 33*a*.

One aspect of the present invention is the inclusion of a very efficient and adjustable foam generating nozzle attachment 33*b* in the assembly of the nozzle part 33*a* and spray angle adjusting member 33*c*. Because of the efficiency of foam generation of the foam generating nozzle attachment 33*b*, the cleaning material contained in the drum 20 can cover and clean effectively an extremely large area, such as an area 6 or more times that which could be covered by a non-foaming liquid spray system. This is what makes the lawn mower sized mobile cleaning unit 2 useful and practical for dispensing maintenance chemicals.

Figure 2:
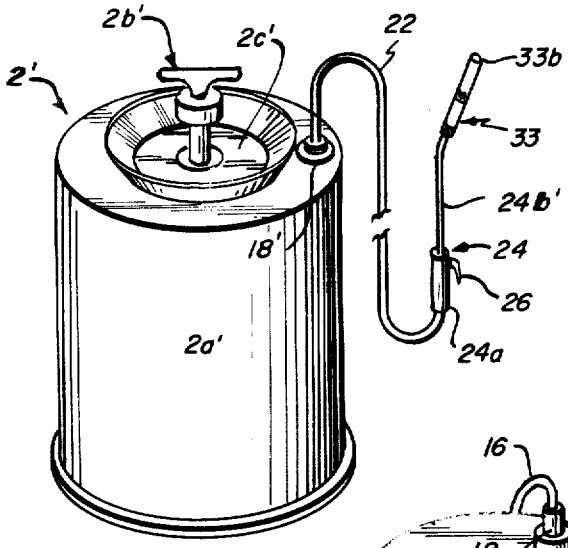
FIG. 2 illustrates a conventional pressurized tank sprayer with the unique foam generating nozzle attachment attached thereto.

Before describing the foam generating nozzle attachment 33b, reference should be made to FIG. 2 which shows another application of this nozzle attachment to a tank sprayer 2' which has a conventional construction except for the attachment 33b used therewith. The tank sprayer 2' has the usual metal tank 2a' with a hand pump handle 2b' extending from a cover 2c' which is sealingly applied in an opening in the top of the tank 2a' by a rotational motion applied to the cover. When reciprocated, the handle 2b' builds up air pressure within the tank 2a'. A flexible outlet conduit 22' extends through a fitting 18' in the tank 2a' and terminates in a handle and nozzle assembly 24 identical to that used with the mobile cleaning unit in FIG. 1. Accordingly, the handle and nozzle assembly 24 includes a handle portion 24a with a lever 26 for opening and closing a valve which effects the passage or stoppage of flow of fluid forced into the conduit 22' by the pressure of the air in the tank 2a'.

The aforementioned nozzle part 33a to which the foam generating nozzle attachment 33b is connected may take a variety of forms. However, as illustrated, the nozzle part 33a includes a neck portion 28 (see FIGS. 4–7) defining a passageway 30 communicating with the metal tube 24b and terminating in a series of laterally facing ports 32 which direct the liquid passing through the nozzle part 33a in a lateral direction. In the nozzle part 33a (manufactured by the Chapin Manufacturing Works), the end portion of the neck 28 thereof is provided with angular grooves or indentations 34.

The aforementioned spray angle adjusting member 33c has a cylindrical passageway 36 therein which at one end opens for the full extent thereof into the outside of the member and at the other end joins a tapered passageway 37 which terminates in a small discharge orifice 42 previously mentioned. The fully opened end of the passageway 36 of the spray angle adjusting member 33c is internally threaded at 38 to permit the member 34 to be threaded around an externally threaded portion 28a of the neck portion 28 of the nozzle part 33a. As the spray angle adjusting member 34 is rotated upon the neck portion 28 to a different axial position thereon, the spacing between the discharge orifice 42 and the laterally facing ports 32 varies which, in turn, varies the angle of divergence of the unfoamed liquid stream emanating from the discharge orifice 42.

In accordance with one aspect of the invention, it was discovered that the unfoamed or mildly foamed liquid spray emanating from the discharge orifice 42 can be converted into a thickly foamed state where the degree of thickness thereof is a function of the angle of divergence of the liquid stream issuing from the discharge orifice 42 by the addition of the foam generating nozzle attachment 33b which, as illustrated, is mounted around the outside of the spray angle adjusting member 34. In the form of the invention illustrated the foam generating nozzle attachment 33b is permanently anchored around the spray angle adjusting member 34. In the most preferred form of the invention, the foam generating nozzle attachment 33b has a hollow cylindrical body 40 which has a longitudinal open ended passageway 40a therein. The spray angle adjusting member 33c is press fitted within one end of the passageway 40a. The cylindrical body may be knurled at a point 40b therealong so it can be readily grasped and rotated to vary the position of the spray angle adjustment member 33c on which it is mounted.

At a point preferably immediately in front of the discharge orifice 42, the cylindrical member 40 is provided with one or more, preferably four, laterally facing circumferentially spaced air ports 43 which pass through the walls of the member. Secured in any suitable way within the cylindrical body 40 at a point immediately in front of the air ports 43 is a pressure-reducing member 44 in which is formed a pressure reducing passageway having an outwardly tapering portion 46a which preferably at its wide end has a width approximately equal to the internal diameter of the cylindrical body 40 and at its narrow end terminates in a cylindrical throat portion 46b. When liquid flows through the air pressure reducing passageway of the member 44, the resultant reduced pressure causes air to be aspirated into the liquid stream through the air ports 43. Foaming of the aerated foamable material results from the turbulence created within the air pressure reducing passageway of the member 44, and the degree of this turbulence and the thickness of the foam generated thereby was unexpectedly discovered to be a function of the angle of divergence of the stream issuing from the discharge orifice 42. This stream is directed against progressively increasing areas of the air pressure-reducing passageway of the member 44 as the angle of divergence of this stream is accordingly increased from a generally thin roughly cylindrical shape (i.e., only slightly diverging) to a widely diverging shape. In the former case, little or no foaming action occurs since the thin stream will pass through the throat portion 46b of the pressure-reducing passageway of the member 44 or will strike only the rear end portion thereof. As the spray angle adjusting member 33c is progressively rotated to increase the angle of divergence of the stream, the stream will first strike progressively increasingly larger areas of the throat portion 46b and then progressively increasing areas of the outwardly tapering portion 46a of the pressure-reducing passageway, which progressively increases the turbulence applied to the aerated liquid stream. It is believed that this turbulence is accentuated by the fact that the outwardly tapering portion 46a is sharply tapered so as to subtend an angle of about at least about 60°, where the walls thereof incline at least about 30° (i.e., including angles somewhat less than 30°) to the longitudinal axis rather than gradually tapered, although the broader aspects of the invention envision a gradual taper.

The quality of the foam issuing from the outlet end of the throat portion 46b of the pressure-reducing passageway of the member 44 is believed to reach an optimum value when the angle of divergence of the stream issuing from the discharge orifice 42 is sufficiently large as first to strike the defining walls of the tapered passageway portion 46a, that is at the end section of the tapered passageway portion. The quality of the foam is firstly a function of its thickness and secondly a function of its rate of flow of the foamed material, since at the widest angle of the stream issuing from the orifice 42 the friction developed beteween the foamed material and the walls of the nozzle attachment can reduce the flow rate to an unacceptably low level.

The cylindrical body 40 in which the pressure-reducing member 44 is mounted could terminate at a point near the outlet end of the throat portion 46b of the pressure-reducing passageway of the member 44. However, it was discovered that a greatly increased foaming action is achieved by selecting a cylindrical body 40 with a length so it extends beyond the end of the point where the air pressure-reducing passageway of the member 44 terminates to provide an expansion chamber 41. However, the expansion chamber 41 has little or no effect in creating an overall enhanced foaming action when the liquid discharged from the end of the pressure-reducing member 44 has not yet been appreciably foamed, so that the main benefit of the expansion chamber 41 is in its combination with a foam producing nozzle in advance of the same (which distinguishes it from the expansion chamber in the foam generating nozzle of U.S. Pat. No. 3,701,482 where the expansion chamber thereof initially creates the foaming action).

While the length to diameter ratios of the various passageways and chambers described may vary widely, there are extremes of these ratios which can destroy the operability of the foam generating nozzle attachment. For example, the length to diameter ratio of the throat portion **46*b* of the pressure reducing passageway of the member 44 is approximately 4 to 1, but if the length of the throat portion 46*b* were to be greatly extended, while a greater contact time between the liquid and the pressure reducing passageway may cause increased foam thickness, the frictional forces involved can reduce the flow velocity to a point where the foamed material will be discharged with insufficient force to travel to the surface to be cleaned and, for all practical purposes, the nozzle attachment would be useless. Similarly, if the length to diameter ratio of the expansion chamber 41 were to be increased materially from an optimum length, the frictional forces involved would reduce the velocity of the foamed material discharged from the end of the nozzle attachment to a point where an inadequate quantity of the material will reach the surface to be cleaned. FIG. 16 illustrates the variation of foam quality with the length to diameter ratio of the expansion chamber 41** and illustrates an improvement of foam quality for length to diameter ratios of from 7 to about 18.

FIGS. 8A–8B and 9A–9B illustrate differences in foam quality for 2° of adjustment of the spray angle adjusting member **33*c*. Thus, FIG. 8A shows the consistency of the foam sprayed from the foam generating attachment 33*b* upon a vertical wall surface 50 for an adjustment of the spray angle adjusting member 33*c* where the angle of divergence of the stream discharging from the orifice 42 is at a small angle which forms a relatively thin foam layer 51 on the vertical wall surface 50 where the bubbles of the foam are relatively large. It can be seen from FIG. 8B, which illustrates the appearance of the foam layer on the vertical wall surface 50 several seconds later, that a substantial portion of the foam bubbles have broken, releasing the liquid portion thereof which runs down the vertical wall surface 50. FIG. 9A shows the consistency of the foam sprayed from the foam generating attachment 33*b* upon a vertical wall surface 50 for an adjustment of the spray angle adjusting member 33*c* where the angle of divergence of the stream discharging from the orifice 42 is an optimum angle, which results in a forcefully applied very thick, fine bubble foam layer 51' on the vertical wall surface 50. In such case, as shown in FIG. 9B,** several seconds later the foam still remains as a thick layer upon the vertical wall surface.

FIG. 10 illustrates the condition of the foam discharging from the foam generating nozzle attachment **33*b* for an adjustment of the spray angle adjusting member 33*c* where the angle of divergence of the stream discharging from the orifice 42 is a maximum where, as previously indicated, the friction between the liquid and the defining walls of the pressure-reducing passageway is such that, while a thick foam is achieved, the foam merely drips from the end of the nozzle attachment so it cannot reach the vertical wall surface 50.**

Refer now more particularly to the embodiment of the nozzle attachment invention illustrated in FIGS. 11–15, which is designed to be attached to a rotatable spray angle adjusting member **33*c'* of a nozzle assembly 33 associated with a hand pump unit 60 manufactured by The AFA Corporation of Miami Lakes, Fla. The hand pump unit 60 has a squeeze handle 62 extending from a body portion 64 thereof adapted to be threaded around the neck of a bottle 66 which may contain a suitable foamable cleaning liquid. A tube 68 extending down into the bottom portion of the bottle 66 makes communication with the inlet side of a valve (not shown) controlled by the handle 62. When the handle 62 is squeezed, a pump forming part of the hand pump unit will operate to draw liquid in the bottle 66 through the tube 68 into the nozzle assembly 33. A modified foam generating nozzle attachment 33*b'* is mounted upon the spray angle adjusting member 33*c'* in a manner to be described, so that as the member 33*c'*** is rotated, the degree of foaming action varies, as in the case of the embodiment of the invention previously described.

As shown in FIG. 15, the spray angle adjusting member **33*c'* has a knurled hollow cylindrical collar 70 which has internal threads 72 which engage the external threads 74 of a nozzle part 33*a'*. The nozzle part 33*a'* has a passageway 30' which is partially closed by an end wall 76 containing one or more apertures 78. The spray angle adjusting member 33*c'* has a neck portion 80 extending forwardly therefrom which has a smooth outer cylindrical surface 80*a* upon which is initially slidably mounted the foam generating nozzle attachment 33*b'*. The neck portion 80 of the spray angle adjusting member 33*c'* terminates in an annnular front wall 82 having a central aperture 84 therein. The neck portion 80 has a cylindrical passageway 86 therein in which is located the end wall 76 of the nozzle part 33*a'*. Anchored within the forward end of the passageway 86 is a member 88 having a discharge orifice 90 therein of much smaller size than and centered with respect to the larger aperture 84 of the annular front wall 82 of the adjusting member 33*c'***.

As the spray angle adjusting member **33*c'* is rotated upon the nozzle part 30*a'*, the spacing between the discharge orifice 90 and the apertures 78 will vary to change the angle of divergence of the stream issuing from the discharge orifice 90.**

The foam generating nozzle attachment **33*b'* is preferably a molded synthetic plastic part which can be made at a very low cost. This attachment contains various passageways and chambers corresponding to those of the foam generating nozzle attachment 33*b* previously described and corresponding passageways and chambers therein are numbered the same, except a prime (') has been added to the passageways and chambers in the foam generating nozzle attachment 33*b'***.

The foam generating nozzle attachment **33*b'* has a cylindrical skirt 91 at the rear end thereof defining a space 92, the defining walls of which form a friction fit with the smoother outer surface 80***a* of the neck 80 of the spray angle adjusting member 33*c*'. The extent to which the skirt 91 slips over the neck 80 is limited by the engagement of the end 94*a* of an internal sleeve 94 with the annular end wall 86 of the spray angle adjusting member. When the foam generating nozzle attachment 33*b*' is fully mounted upon the neck 80, the end portion 90*a* of the skirt 91 is spaced from the end of the knurled collar 70 to define an annular entryway 96 for passage of air into the interior of the skirt 91. The skirt 91 as illustrated has outwardly projecting ribs 97 providing thickened wall portions in which are formed internal longitudinal recesses or grooves 99 opening onto the rear end of the nozzle attachment. The recesses or grooves 99 carry air from the entryway 96 into the space 92 in the skirt 91. Air in the space 92 passes through air ports 43'—43' formed in the rear end of the sleeve 94, through which ports air is drawn into an inlet portion 46*c*' of the pressure reducing passageway formed in the central portion of the body of the nozzle attachment 33*b*'. The inlet portion 46*c*' terminates in a sharply outwardly tapering portion 46*a*', in turn, merging with the throat portion 46*b*' of the pressure-reducing passageway of the attachment. As in the previously described embodiment, the throat portion 46*b*' terminates in an expansion chamber 41' extending to the front end of the nozzle attachment.

The foam generating nozzle attachment 33*b*' just described effects foaming of the liquid spray emanating from the orifice 90 in the same manner as the foam generating nozzle attachment 33*b* previously described. Thus, the variable angle diverging stream issuing from the orifice 90 into the inlet portion 46*c*' strikes progressively increasing areas of the air pressure reducing passageway formed by the passageway portions 46*c*', 46*a*' and 46*b*' as the angle of divergence of the stream increases.

While the most preferred forms of the invention include a nozzle assembly which is adjustable in a manner which varies the angle of a diverging stream which strikes varying portions of a pressure-reducing passageway as described, the broader aspects of the invention envision an adjustable nozzle assembly in which the stream angle issuing from the aforementioned orifices is constant and the relative position between the orifice and the pressure-reducing passageway is varied. Also, the present invention envisions a non-adjustable sprayer where the stream angle is selected to provide a optimum foam spray as previously described.

Refer now more particularly to FIGS. 17A, 17B and 17C which illustrate three different stream angles and the points of a tapered passageway portion 46*a*' struck by the widest portion of the diverging streams to produce an optimum foam spray. It will be noted that, in each case, this condition exists when the widest portion of the diverging stream strikes the end section of the tapered passageway portion 46*a*'. (However, the best foaming action was achieved when the stream angle was about 20° and the tapered passageway portion 46*a*' inclined at a 30° angle to the longitudinal axis of the pressure-reducing passageway). In each case, as the diverging stream was moved toward the throat portion 46*b*' from the optimum position shown in FIGS. 17A, 17B and 17C, the foam quality rapidly deteriorated. As the diverging stream was moved away from the throat portion 46b' from the optimum position described, the foam rapidly thickened and the throw distance of the spray issuing from the nozzle assembly rapidly deteriorated.

As previously indicated, for the optimum position of the diverging stream striking the pressure-reducing passageway of the nozzle assembly, the spray issuing from the nozzle assembly upon striking a vertical wall surface strangely builds up a thicker layer of foam which dissipates more slowly than the case where an apparently thicker foam issuing from the nozzle assembly is sprayed at a lower velocity against a vertical wall surface. It is believed that the turbulence created upon impact of a higher velocity spray against a wall surface enhances the quality of the foam which causes the foam to remain in place for a longer period on the wall surface.

While the advantages of the invention are maximized in an adjustable sprayer as described, certain aspects of the invention are applicable also to a non-adjustable sprayer 70 as shown in FIGS. 18–21, to which reference is now made. This sprayer is a modification of the sprayer shown in U.S. Pat. No. 3,685,739 granted Aug. 22, 1972. The hand trigger sprayer 70 has an integrally threaded collar 72 adapted to thread over the neck of a container 73. Depending downwardly from the collar 72 is an inlet tube 74 through which liquid is drawn from the container in the manner disclosed in said U.S. Pat. No. 3,685,739, upon the squeezing of a lever 76 pivoted at a point 78 to the body portion 80 of the sprayer.

The body portion 80 of the sprayer includes a liquid-receiving chamber 82 in which is mounted a piston member 84 urged by a spring 86 into an outer position. When the lever 76 is squeezed, piston 84 compresses the spring 86 and reduces the size of the chamber 82 so that liquid delivered to the chamber 82 will be forced through a first longitudinal passageway 88 opening onto an enlarged passageway 90 communicating with a discharge orifice 92 formed in the head portion 110 of an insert member 106. Mounted for limited longitudinal movement in the passageway 90 is a liquid-directing member 94 shown in detail in FIGS. 20 and 21.

The liquid-directing member 90 has a flat rear face 96 adapted to engage and seal about shoulder 97 surrounding the point at which the passageway 88 opens onto the passageway 90 when the lever 76 is in its uncompressed position. The force of the liquid flowing from the chamber 82 upon squeezing of the lever 76 forces the liquid-directing member 94 forwardly in the passageway 90, permitting the flow of liquid around the fluid-directing member 90.

The fluid-directing member 94 has a small shallow recess 98 in the front wall thereof opening onto the lateral sides of the member through entryways 100—100. The original purpose of the recess 98 and entryways 100—100 is to permit liquid to gain access to the orifice 92 should this member be permitted to move fully forwardly within the passageway 90, as in the case of the design of the sprayer before the modifications thereto in accordance with the present invention.

The forward end of the passageway 90 is defined by the cylindrical interior 104 of the insert member 106 having a cylindrical skirt portion 106*a* friction fitted within the body member 80. The skirt portion 106*a* of the insert member 106 defines a rearwardly facing shoulder having a function to be explained.

The radially outwardly extending head portion 110 of the insert member 106 is located on the outside of the sprayer body 80 and a foam-producing attachment 112 having a base portion 112*a* is interlocked with the head portion 110 of the insert member 106 in any suitable way. The foam-producing attachment 112 has a succession of passageways and apertures which may be similar to that shown in the foam-producing nozzle assemblies previously described. Thus, the foam-producing attachment 112 has a cylindrical inlet chamber 114 into which the orifice 92 of the insert member 106 opens. Air inlet apertures 115 extend through the body of the attachment 112 so that the inlet chamber 114 communicates with the exterior thereof. The inlet chamber 114 terminates in a sharply forwardly tapering pressure-reducing passageway portion 116 which, in turn, terminates in a cylindrical throat 118 opening onto an enlarged expansion chamber 120. The liquid stream passing into the inlet chamber 114 has a forwardly diverging shape so that the wide end thereof most advantageously strikes the end section of the tapering portion 116, to produce optimum foaming action as previously described.

The angle of the stream issuing from the orifice 92 is a function of the spacing between the inner surface of the recess 98 in the front face of the fluid-directing member 94 and the orifice 92. If the front of the fluid-directing member 94 is against the head portion 110 of the insert member, the angle of the stream diverging from the orifice 92 will not be a desired angle to strike the desired portion of the tapered portion 116 of the pressure-reducing passageway of the attachment 112. Accordingly, the fluid-directing member 94 is provided with two or more radially extending ribs 122—122 which define an abutment shoulder which engages the end face of the skirt portion 106*a* of the insert member 106 when the front face of the fluid-directing member 94 reaches the proper spacing from the head portion 110 of the insert member, to provide the proper angle for optimum foaming action.

The various forms of the invention described thus provide simply constructed and economical foam generating means providing preferably a selective thickness and throw of the foam under varying pressure and spray material conditions or, in the non-adjustable form of the invention, an optimum foam spray.

It should be understood that numerous modifications may be made in the various forms of the invention described, without deviating from the broader aspects of the invention.

I claim:

1. An adjustable foam generating nozzle assembly comprising, in combination: body means defining an inlet section through which an unaerated liquid can pass, said inlet section including outlet orifice-forming means through which unaerated liquid passes for providing a diverging stream flowing therefrom; said body means further defining a foam-producing section downstream from said inlet section which foam-producing section has an inlet end which receives the entire variably shaped stream issuing from said outlet orificeforming means, air inlet port-forming means in communication with the exterior of the nozzle assembly and pressure-reducing passageway means communicating with said air inlet port-forming means and said inlet end for effecting the aspiration of air through said air inlet port-forming means and the mixing thereof into the liquid stream passing through the pressure-reducing passageway means; and said inlet section of said body means including manually adjustable means for progressively varying the shape of said stream flowing from said orifice-forming means from a relatively narrowly confined stream to a relatively widely diverging stream as the manually adjustable means is varied for thereby varying the portions of the pressure-reducing passageway struck by the stream, the turbulence produced in the aerated stream passing therethrough, the degree of foam thickness and the throw of the stream flowing from the nozzle assembly.

2. The adjustable foam generating nozzle assembly of claim 1 wherein said manually adjustable means of said inlet section of the nozzle assembly is a rotatable member, and said foam-producing section of said body means is carried by said rotatable member.

3. The adjustable foam generating nozzle assembly of claim 1 wherein said pressure-reducing passageway means includes an outwardly tapering portion merging with a throat portion.

4. The adjustable foam generating nozzle assembly of claim 3 wherein said pressure reducing passageway means is positioned with respect to said orifice-forming means so the diverging stream issuing from the latter strikes progressively increasing areas of said outwardly tapering and throat portions of said pressure-reducing passageway means as said manually adjustable means is adjusted to increase the angle of divergence of said stream.

5. The adjustable foam generating nozzle assembly of claim 3 wherein the spacing of said orifice-forming means from said tapered portion of said pressure-reducing passageway is such that the diverging stream issuing therefrom strikes progressively increasing areas of said tapered portion of said pressure-reducing passageway means as said manually adjustable means is adjusted to increase the angle of divergence of said stream.

6. The nozzle assembly of claim 1 wherein said manually adjustable means is continuously adjustable to all positions between two extreme positions where said stream has its narrowest and widest dimensions, so the quality of the foam stream issuing from the nozzle assembly can be adjusted to any desired degree.

7. An adjustable foam generating nozzle assembly comprising, in combination: body means defining an inlet section through which liquid can pass, said inlet section including an outlet orifice-forming means through which liquid passes for providing an outwardly diverging shape to the stream flowing therefrom; said body means further defining a foam-producing section downstream from said inlet section which foam-producing second has an inlet end which receives the stream issuing from said outlet orifice-forming means, air inlet portforming means in communication with the exterior of the nozzle assembly, pressure-reducing passageway means communicating with said air inlet port-forming means and said inlet end for effecting the aspiration of air through said air inelt port-forming means and the mixing thereof into the liquid stream passing through the pressure-reducing passageway means; and said inlet section of said body means including manually adjustable means for progressively varying the shape of said stream flowing from said orifice-forming means from a relatively narrowly confined stream to a relatively widely diverging stream as the manually adjustable means is varied for thereby varying the portions of the pressure-reducing passageway struck by the stream which substantially varies the thickness of the foam stream discharged from said assembly.

8. The nozzle assembly of claim 7 wherein said manually adjustable means is continuously adjustable to all positions between two extreme positions so the quality of the foam stream issuing from the nozzle assembly can be adjusted to any desired degree.

9. An adjustable foam generating nozzle assembly comprising, in combination: body means defining an inlet section through which liquid can pass, said inlet section including an outlet orifice-forming means through which liquid passes for providing an outwardly diverging shape to the stream issuing therefrom; said body means further defining a foam-producing section downstream from said inlet section which foam-producing section has an inlet end which receives the stream issuing from said outlet orifice-forming means, air inlet portforming means in communication with the exterior of the nozzle assembly, pressure-reducing passageway means communicating with said air inlet portforming means and said inlet end for effecting the aspiration of air through said air inlet portforming means and the mixing thereof into the liquid stream passing through the pressure-reducing passageway means, said pressurereducing passageway means including an outwardly tapering portion merging with a throat portion, and manually adjustable means operatively associated with one of said inlet and foam producing sections of said body means for progressively varying the portions of said pressure-reducing passageway initially struck by the diverging stream issuing from said outlet orifice-forming means so the widest portion of said diverging stream selectively can be made to strike at least one part of said outwardly tapering portion thereof and other portions of said passageway to varying degrees to vary the character of the stream discharged from said assembly substantially.

10. The nozzle assembly of claim 9 wherein said pressure-reducing passageway means is positioned with respect to said orifice-forming means so the stream issuing therefrom strikes progressively increasing areas of both said outwardly tapering throat portions of said pressure-reducing passageway means as said manually adjustable means is adjusted.

11. The nozzle assembly of claim 9 wherein the spacing of said orifice-forming means is such that the stream issuing therefrom strikes progressively increasing areas of said tapered portion of said pressure-reducing passageway means as said manually adjustable means is adjusted.

12. An attachment for a liquid spray nozzle unit including a body carrying a manually rotatable member having outlet orifice-forming means through which liquid passes with a shape which varies progressively from a relatively narrowly confined stream to a relatively widely diverging stream as the manually rotatable member is rotated; the attachment comprising body means including means for mounting the same on said rotatable member and having an inlet for receiving the variably shaped stream issuing from said outlet orifice-forming means of said rotatable member, and pressure-reducing passageway means downstream from and communicating with said inlet, said body means having air inlet port-forming means in communication between the exterior of the attachment and said pressure-reducing passageway means, said body means having a longitudinally extending skirt adapted to surround a portion of said rotatable member, said air port-forming means including longitudinal internal recesses formed in said skirt which extend between the exterior of the attachment and the space within the skirt when the attachment is mounted on the rotatable member, said pressure-reducing passageway means effecting the aspiration of air through said air inlet port-forming means and the mixing thereof into the liquid stream passing through the attachment with a resulting turbulence which varies in degree substantially with the shape of the stream issuing from said orifice-forming means of the nozzle assembly.

13. An attachment for a liquid spray nozzle unit including a body carrying a manually rotatable member having outlet orifice-forming means through which liquid passes with a shape which varies progressively from a relatively narrowly confined stream to a relatively widely diverging stream as the manually rotatable member is rotated; said rotatable member having a manually engageable portion from which forwardly extends a reduced neck portion terminating in a forwardly facing annular end wall at which said orifice-forming means is located; the attachment comprising body means including means for mounting the same on said rotatable member and having an inlet for receiving the variably shaped stream issuing from said outlet orificeforming means of said rotatable member, and pressure-reducing passageway means downstream from and communicating with said inlet, said body means having air inlet port-forming means in communication between the exterior of the attachment and said pressure-reducing passageway means, said inlet being defined by a rearwardly projecting sleeve surrounded by a skirt spaced therefrom and mountable around said reduced neck portion of said rotatable member, said sleeve having one or more laterally facing apertures therein, the defining walls of which at least partly constitute said air port-forming means, the rear end of said sleeve terminating inwardly of the end of said skirt a distance such that the rear end of said skirt will engage said forwardly facing annular end wall of said liquid spray nozzle unit before the rear end of the skirt contacts said manually engageable portion of said rotatable member, so as to define an annular entryway into the space defined between said skirt and said sleeve, and there being formed in the inwardly facing surface of said skirt one or more internal recesses which will extend between said annular entryway and the spaced within said skirt when the attachment is mounted on the rotatable member, to form one or more passageways for the flow of air into the space within the skirt, said pressure-reducing passageway means effecting the aspiration of air through said air inlet port-forming means and the mixing thereof into the liquid stream passing through the attachment with a resulting turbulence which varies in degree substantially with the shape of the stream issuing from said orifice-forming means of the spray nozzle unit.

14. A foam generating nozzle assembly comprising, in combination: body means defining an inlet section through which liquid can pass, said inlet section including outlet orifice-forming means through which liquid passes for providing an outwardly diverging stream flowing therefrom, said body means further defining a foam-producing section downstream from said inlet section which form-producing section has an inlet end which receives the stream issuing from said outlet orifice-forming means, air inlet port-forming means in communication with the exterior of the nozzle assembly and pressure-reducing passageway means communicating with said air inlet port-forming means and said inlet end for effecting the aspiration of air through said air inlet port-forming means and the mixing thereof into the liquid stream passing through the pressure-reducing passageway means, said pressure-reducing passageway means including an outwardly tapering portion merging with a throat portion, said outwardly tapering passageway portion of said pressure-reducing passageway tapering sharply at an angle of at least about 30 degrees relative to the longitudinal axis thereof, said outlet orifice-forming means being positioned relative to said pressure-reducing passageway so the widest portion of said stream issuing therefrom strikes said sharply tapering passageway portion, whereby turbulence is produced in the aerated stream passing therethrough to a degree which produces a highly foamed stream.

15. A foam generating nozzle assembly comprising, in combination: body means defining an inlet section through which liquid can pass, said inlet section including outlet orifice-forming means through which liquid passes for providing an outwardly diverging stream flowing therefrom, said body means further defining a foam-producing section downstream from said inlet section which foam-producing section has an inlet end which receives the stream issuing from said outlet orifice-forming means, air inlet port-forming means in communication with the exterior of the nozzle assembly and pressure-reducing passageway means communicating with said air inlet port-forming means and said inlet end for effecting the aspiration of air through said air inlet port-forming means and the mixing thereof into the liquid stream passing through the pressure-reducing passageway means, said pressure-reducing passageway means including an outwardly tapering portion merging with a throat portion, said outlet orifice-forming means being positioned relative to said pressurereducing passageway so the widest portion of said stream issuing therefrom strikes the end section of said tapering passageway portion whereby turbulence is produced in the aerated stream passing therethrough to a degree which produces a highly foamed stream of appreciable throw.

16. The nozzle assembly of claim 15 wherein said outwardly tapering passageway portion of said pressure-reducing passageway means tapers sharply at an angle of at least about 30 degrees relative to the longitudinal axis thereof.

17. A method of providing a foam generating nozzle assembly which produces an optimum desired foam quality, said nozzle assembly including body means defining outlet orifice-forming means for providing an outwardly diverging stream issuing therefrom and a foam-producing section having an inlet end downstream from said outlet orifice-forming means which inlet end receives the stream issuing from said outlet orifice-forming means, and pressure-reducing passageway means downstream from and communicating with said inlet end, said pressure-reducing passageway means including an outwardly tapering portion merging with a throat portion, there being provided on said body means adjusting means for varying the areas of said pressure-reducing passageway means struck by the streams to flow from said orifice-forming means and air inlet port-forming means in communication between the exterior of the nozzle assembly and said pressure-reducing passageway means, said method comprising connecting the inlet section of the nozzle assembly to a source of liquid to be sprayed and adjusting said adjusting means so that the wide portion of said diverging stream flowing from said orifice-forming means strikes the end section of said outwardly tapering portion of said pressure-reducing passageway.

18. The method of claim 16 wherein the adjustability of the area of said outwardly tapering portion of said pressurereducing passageway struck by the wide portion of said diverging stream is achieved by varying the angle of the diverging stream issuing from said outlet orifice-forming means.

19. In a sprayer comprising body means defining an inlet end into which liquid to be sprayed is drawn and a first passageway through which liquid from said inlet end is to pass, said first passageway terminating in an end opening onto a second passageway terminating in discharge orifice means, a fluid-directing member mounted for longitudinal movement in said second passageway between a position where suction at the inlet end draws the same into sealing relationship with the end of said first passageway and a second position spaced from the end of said first passageway under conditions of fluid pressure, said fluid-directing member when spaced from the end of said first passageway permitting passage of liquid from said first passageway to the orifice means at the end of said second passageway, said fluid-directing member when positioned against said orifice means resulting in the flow of liquid from said orifice means at a first given angle and when spaced a given distance from said orifice means resulting in flow of liquid through said orifice means at a second given angle, the improvement comprising foam-producing body means on said body means and positioned beyond said orifice means and having an inlet end which receives the stream issuing from said orifice means, air inlet port-forming means in communication with the exterior of the sprayer and pressure-reducing passageway means communicating with said latter inlet end for effecting the aspiration of air through said air inlet port-forming means and the mixing thereof into the liquid stream passing through the pressure-reducing passageway means to form the same to a degree which varies substantially with the angle of the stream issuing from said orifice means and reaching a given desired condition when said diverging stream angle is said second given angle, and motion limiting means for limiting the movement of said fluid-directing member to said position spaced said given distance from said orifice means.

20. The sprayer of claim 19 wherein said pressure-reducing passageway means includes an outwardly tapering portion terminating in a throat portion, and said outwardly tapering portion being positioned relative to said orifice means wherein the widest portion of the stream discharging from said orifice means at said second given angle when said fluiddirecting member is in said position spaced from said orifice means will strike said outwardly tapering portion of said pressurereducing passageway.

* * * * *